United States Patent [19]

Wright

[11] 4,413,923

[45] Nov. 8, 1983

[54] SELF-CLEANING REFLECTIVE ROAD MARKER

[76] Inventor: Bernard Wright, Burnside Cottage, Dalguise, Dunkeld, Perth, Scotland

[21] Appl. No.: 262,795

[22] Filed: May 11, 1981

[30] Foreign Application Priority Data

May 13, 1980 [GB] United Kingdom ..... 8015815

[51] Int. Cl.[3] ..... E01F 9/00

[52] U.S. Cl. ..... 404/11; 404/10

[58] Field of Search ..... 404/10, 11, 16

[56] References Cited

U.S. PATENT DOCUMENTS

| | | | |
|---|---|---|---|
| 2,941,447 | 6/1960 | Abbott | 404/11 X |
| 3,216,335 | 3/1962 | Stolarczyk et al. | 404/11 |
| 3,570,377 | 3/1971 | Gerber | 404/10 |
| 4,049,358 | 9/1977 | King et al. | 404/11 |
| 4,130,370 | 12/1978 | Kone | 404/11 |

FOREIGN PATENT DOCUMENTS

| | | | |
|---|---|---|---|
| 216369 | 7/1958 | Australia | 404/11 |
| 731876 | 6/1955 | United Kingdom | 404/11 |
| 1176608 | 1/1970 | United Kingdom | 404/11 |
| 1202715 | 8/1970 | United Kingdom | 404/11 |
| 1324355 | 7/1973 | United Kingdom | 404/11 |

*Primary Examiner*—James A. Leppink
*Assistant Examiner*—Beverly E. Hjorth
*Attorney, Agent, or Firm*—Gerald J. Ferguson, Jr.; Joseph J. Baker

[57] ABSTRACT

A self-cleaning reflective road marker comprises a housing formed of a generally cylindrical portion insertable into the road and a flanged portion for lying on the road surface connected thereto. The housing contains a stud mounted on a rubber hemisphere. The stud contains a circular reflector and the housing contains a circular o-ring located in the flanged portion opposite the reflector. In response to the passing of a tire over the marker, the stud is depressed and the reflector is wiped clean by the o-ring. On removal of the tire force, the resilience of the rubber hemisphere forces the stud into its original position and the reflector is further cleaned by the o-ring.

The stud consists of two parts connected together, from above by a threaded bolt such that when the marker is fixed in the road the part can be removed to enable removal or replacement of the reflector and the o-ring.

14 Claims, 4 Drawing Figures

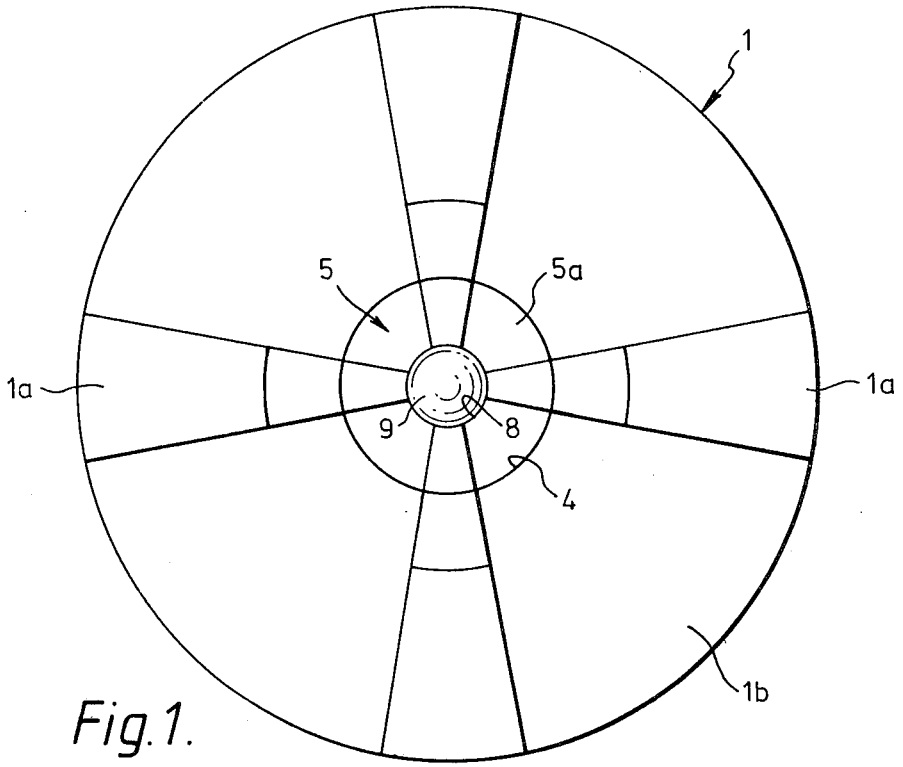
Fig. 1.
Fig. 3.
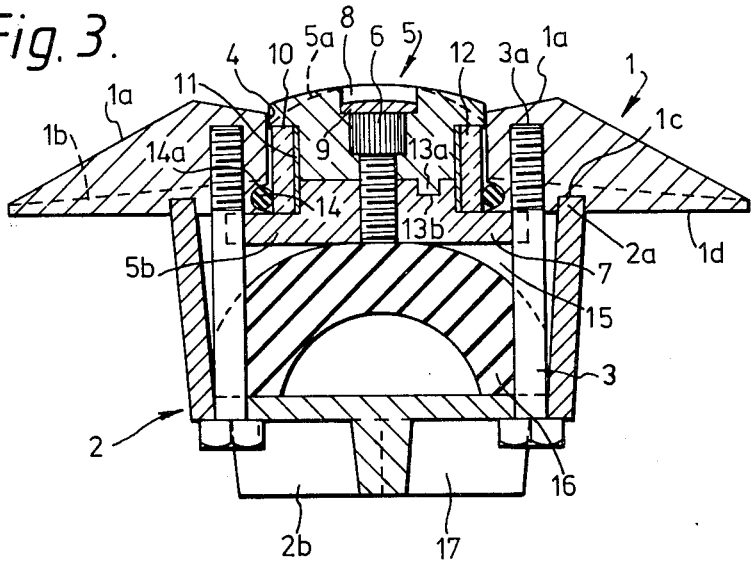

SELF-CLEANING REFLECTIVE ROAD MARKER

The present invention relates to self-cleaning reflective road markers of the kind having a housing insertable into the road surface, a stud movably located within the housing, said stud carrying a reflector, said stud being movable from a first position to a second position in response to an actuating force resilient means located within the housing for urging the stud from the second position to the first position upon removal of said actuating force and reflector cleaning means located in the housing between said first and said second positions.

In U.K. Pat. No. 266,904 there is disclosed an omnidirectional self-cleaning road marker. The reflector is spherical and when a tyre passes over the reflector, the reflector is simultaneously depressed against a coil spring and rotated past an o-ring which effects a wiping action on the reflector surface. On removal of the force applied by the tyre the reflector is urged into its normal reflecting position. A flat annular disc is removably mounted on the marker and enables the reflector and the rubber o-ring to be replaced.

A disadvantage of this type of marker is that the reflector per se is in contact with the wheels and therefore it becomes damaged and requires frequent replacement. In addition, dirt and oil can accumulate at the junction of the flat disc and the reflector impairing the effectiveness of the reflector. Furthermore, it is only possible to use a reflector of one colour which may limit the usefulness of the device when area or lane segregation is desired.

In U.K. Pat. No. 648,542 a reflective self-cleaning road marker has four reflectors circumferentially spaced around the stud which is depressible under the action of a wheel force relative to the housing. The stud is not rotatable relative to the housing. The housing has an upper circular flanged portion with four sloped shoulders equiangularly spaced to give protection to the stud against snowploughs and the like. Each reflector is located between a respective pair of shoulders to reflect light, effectively giving 360° reflectivity. The entire upper flanged portion is removable from the lower portion, which enables the o-ring to be replaced and facilitates replacement of a damaged reflector.

A disadvantage of this type of marker is that the whole upper flange requires to be removed to carryout replacement which is time-consuming and cumbersome. A further disadvantage is that the o-ring is continuously exposed to the exterior and is in contact with hydrocarbons which can result in rapid perishing of the rubber. Dirt, hydrocarbons and the like can also build up at the junction of the flat o-ring surface and the reflector reducing the effectiveness of the marker. The reflectors are permanently located in the stud and thus the whole stud requires to be replaced, which is expensive.

U.K. Pat. No. 696,707 discloses an omnidirectional self-cleaning road marker having a removable reflector. The marker comprises a hollow mushroom-shaped rubber member with the stem having an internally screw-threaded member bonded thereto. The reflectors are mounted in a screw-threaded stud which is engageable within the internally screw-threaded member such that the reflectors just extend above the rubber dome of the marker. When a tyre passes over the marker the stud and the bonded member are depressed due to the extensibility of the rubber stem. On removal of the tyre force the resilience of the rubber urges the stud back into its original position. During such movement the reflectors are wiped against the inner rubber surface of the stem and are thereby cleaned.

One major disadvantage of this type of road marker is that the constant shearing action between the internal sleeve and the rubber to which it is bonded results in failure of the bond, or rupture of the rubber stem, with the consequence that once the stud is depressed it stays depressed and therefore is useless. A further disadvantage of this device is that the rubber dome was exposed to hydrocarbons from traffic causing rapid perishing of the rubber which necessitated frequent replacement and expense. The reflectors are not removable from the stud and if reflectors are damaged the whole stud requires to be replaced. In addition, if the stud is not screwed up to a predetermined torque it may work loose such that the reflectors are not cleaned and giving rise to a potential driving hazard.

The invention claimed is intended to provide a remedy. It solves the problem of providing a replaceable reflector and cleaning means by using a two-part depressible stud which retains the reflector when the parts are connected together one part of the stud being removable when in-situ whereby the reflector and the cleaning means can be removed for examination and/or replaced.

Advantages offered by the invention are that, the whole stud does not require to be removed from the road; the replacement procedure is very rapid and requires only conventional tools; the colour of reflector can be quickly changed to suit traffic conditions; the simplicity of the invention provides an efficient self-cleaning reflective marker which is maintainable for very low cost, and the marker is flexible in that it can be rapidly adapted not only for use on roads but also on aircraft runways, and the like.

An embodiment of the present invention will now be described by way of example with reference to the accompanying drawings in which:

FIG. 1 is a top plan view of a reflective road marker according to the present invention;

FIG. 3 is a schematic sectional view of the road marker shown in FIGS. 1 and 2.

Figure 2:
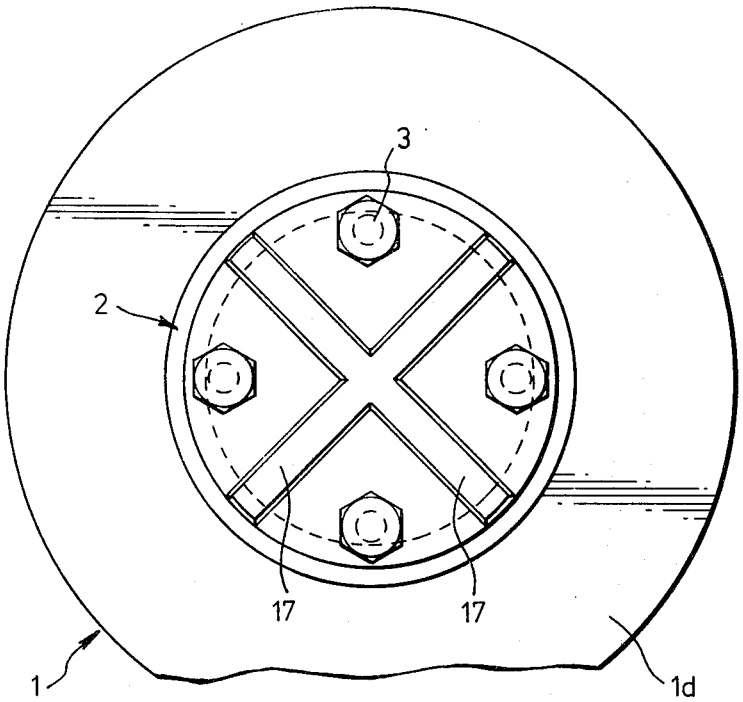
FIG. 2 is a bottom plan view of the reflective road marker according to the present invention.
Figure 4:
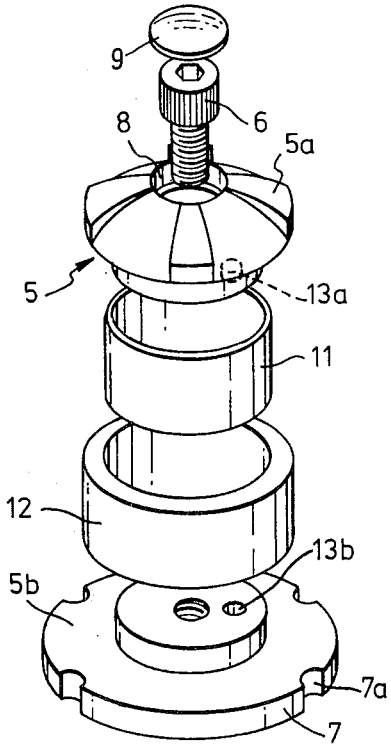
FIG. 4 is an exploded view of the stud of the road marker shown in FIGS. 1,3.

Referring now to the drawings, a reflective road marker comprises a generally circular flanged disc 1 and a slightly frustoconical road mounting portion 2. The disc 1 has four equiangularly spaced shoulders 1*a* and a flanged portion 1*b* which radially extends beyond the portion 2 and which also extends around the circumference of the portion 2 (FIG. 2). The flanged portion 1*b* also slopes radially down towards the outer circumference (FIG. 3). The flanged disc 1 is secured to the mounting portion 2 by four bolts 3, each bolt being located so that its threaded head 3*a* is received by an internally threaded portion of a respective shoulder 1*a*. When the bolts are secured a lip 2*a* of the mounting portion 2 nestingly engages in a circumferential channel 1*c* of the flanged disc 1. The flanged disc portion 1 has a circular aperture 4 in which a generally cylindrical stud 5 is located. The cylindrical stud 5 consists of two portions; an upper portion 5*a* and a lower plate-shaped portion 5*b* having an internally captured thread. The portion 5*a* is secured to the portion 5*b* by a threaded screw 6. The portion 5*b* has a lip 7 which abuts the lower surface 1*d* of the flanged portion 1. The lip 7 has four cut-outs 7*a* each of which engages with a respective bolt 3 (FIGS. 3–5). When the portions 5*a*,5*b* are secured together a recess 8 (FIGS. 1,3) remains in portion 5*a* into which a removable and/or disposable cap 9 is located. The cap 9 presents ingress of dirt and oil into the recess 8. When the portions 5*a*,5*b* are connected together as shown in FIG. 3 an annular rectangular channel section 10 is defined. A circumferential reflector 11 is located in the section 10 and is covered by an annular glass cover 12. The reflector 11 is made of a highly reflective laminated sheeting and the cover 12 is made of borosilicate glass which is highly resistant to scratching. A key 13*a* is located in the lower surface of portion 5*a* which engages with a keyway 13*b* in the disc portion 7*c* of the lower portion 5*b*, which presents the upper portion 5*a* rotating relative to the lower portion 5*b*.

A rubber o-ring 14 is located in a recess 14*a* in the flanged portion 1*b*, the inner surface of the o-ring being of a slightly small diameter than the cover glass 12 whereby the o-ring 14 presses lightly on the cover glass 12. The lower surface 7 of the portion 5*b* and the interior of the mounting portion 2 define a chamber 15 in which a resilient rubber pad 16 is located. The pad 16 is of a hollowed-out hemispherical shape which has been formed to give suitable performance. The pad 16 has four cut-outs which are spaced around the pad, so that one cut-out engages with a respective bolt 3. The base 2*b* of the housing portion 2 has intersecting plates 17 extending therefrom, the plates serving to provide increased attachment between the road surface and the marker, and to prevent rotation of the disc relative to the road surface.

In use, when the road marker is to be located in the road surface, a generally cylindrical core is taken from the surface and an adhesive inserted, such as tar or any other suitable adhesive. The marker is then inserted into the road surface such that the underside 1*d* of the disc 1 abuts the road surface. When a tyre passes over the marker, the weight causes the stud 5 to be depressed relative the portions 1 and 2 compressing the rubber pad 16 and forcing the cover glass 12 past the rubber o-ring 14 whereby any dirt or traffic film is removed from the glass surface. The bolts 3 act as guides for the plate 5*b* to prevent rotation of the whole stud 5 and to give consistent reciprocating movement. When the tyre weight is removed the resilience of the rubber pad forces the stud 5 back through the o-ring 14 providing further cleaning of the cover glass and into its original position, travel in the upwards direction being limited by the lip 7 abutting surface 1*d* of disc 1*b*.

When the reflector 10 and/or o-ring 14 are to be removed for examination and/or replaced, the plastic cap 9 is removed by a sharp instrument such as an awl and the threaded screw 8 unscrewed. The portion 5*a* is then lifted off and the cover glass 12 and the reflector 11 can be removed. Similarly the o-ring 14 can be easily removed from its recess 14*a*.

The flanged portion 1*b* is sloped away from the reflector 11 so that passing tyres can disperse dirt and oil from the reflector. Also rain water and other liquids will drain away from the reflector removing dirt and grit.

The gaps between the shoulders 1*a* in effect permit reflectivity over 360° to be achieved. The engagement of the cut-outs 7*a* with the bolts 3 enable the stud portion 5*a* to be screwed or unscrewed relative to the portion 5*b*.

The housing is a casting made from white nylon which is usuable over a temperature range of −45° C. to +100° C. without structural change thus rendering the marker suitable for use in regions of extreme temperatures. The large area of the flange also ensures that that weight is evenly distributed over the flange, so that the marker does not sink into the road surface over a period of time.

A further aspect of the flexibility of this marker is that the colour of the reflector can be varied to suit different applications, e.g. a green reflector to indicate entry lanes and a red reflector to indicate exit lanes. Similarly, two or more different colours, up to four, may be combined on the same reflector of one marker, for example one half of the reflector could be red and the other half could be green. This would reduce the number of markers required for lane delineation.

Although the markers hereinbefore described are intended for use on roads they could readily be used where other forms of traffic are used e.g. for air traffic on runways.

The road stud can be manufactured in a variety of sizes to suit different requirements, and in the UK is dimensioned such that it satisfies requirements for road studs specified by the Ministry of Transport; and The omnidirectional reflectivity of the stud ensures that traffic approaching the studs from any direction are warned of potential hazards.

What I claim is:

1. A self-cleaning reflective road marker comprising:

a housing having a generally cylindrical portion for insertion into a road surface and including a flanged portion, the flanged portion being connected to the generally cylindrical portion by connectors;

a stud comprising first and second stud portions connected together to secure a reflector on the stud wherein the second stud portion is generally circular and includes a plurality of equally spaced cut-outs for engaging said connectors whereby when the stud moves between said first and said second position, the movement of the stud is guided by the co-operation of the cut-outs and the connectors;

resilient means biasing the stud upwardly in the housing; and reflector cleaning means located in the housing in a position to wipe the reflector when the latter is depressed against the bias of the resilient means;

the first and second stud portions being connected together by connector means engageable from above the road marker only to effect disconnection of said stud portions;

the first stud portion upon such disconnection being removable upwardly from the road marker, whereby the reflector and the cleaning means may be removed and replaced without removal of the housing from the road surface.

2. A self-cleaning road marker as claimed in claim 1 wherein said connector means comprises a threaded connector sealed in the stud by a disposable cap.

3. A self-cleaning road stud as claimed in claim 1 wherein the stud is generally cylindrical and the reflector is circumferentially extending.

4. A self-cleaning road marker as claimed in claim 1 wherein a light transmissive cover is located on the reflector, said cover abutting said cleaning means and being cleaned when said stud is moved between said first and said second positions.

5. A self-cleaning road marker as claimed in claim 4 wherein said cover is a borosilicate glass material.

6. A self-cleaning road marker as claimed in claim 1 wherein the resilient member is a generally hollow hemispherical shape.

7. A self-cleaning road marker as claimed in claim 1 wherein said first stud portion and said stud portion are keyed together to prevent relative rotation.

8. A self-cleaning road marker as claimed in claim 1 wherein the cleaning means is located beneath the level of the flanged portion.

9. A self-cleaning road marker as claimed in claim 1 wherein the housing portion includes marker securing members to prevent rotation of the marker relative to the road when in-situ.

10. A self-cleaning road marker as claimed in claim 1 wherein the flanged portion has a surface which is sloped down from the reflector to the road surface.

11. A self-cleaning road marker as claimed in claim 1 wherein there are four shoulders equally spaced on the flanged portion.

12. A self-cleaning road marker as claimed in claim 11 wherein the reflector is formed of of a plurality of different coloured sections, each coloured section being visible between respective pairs of shoulders.

13. A self-cleaning road marker as claimed in claim 1 wherein the housing and the first and second stud portions are formed of white nylon having a working temperature range of −45° C. to 100° C.

14. A self-cleaning reflective road stud as claimed in claim 1 wherein the generally cylindrical housing portion is frustoconical.

* * * * *